US007143457B2

(12) United States Patent
Macdonald

(10) Patent No.: US 7,143,457 B2
(45) Date of Patent: Dec. 5, 2006

(54) TEXTILE CONSTRUCTION

(76) Inventor: Robert J. Macdonald, 3674 McLachlin Road, R.R.#1, Perth, Ontario (CA) K7H 3C3

( * ) Notice: Subject to any disclaimer, the term of this patent is extended or adjusted under 35 U.S.C. 154(b) by 0 days.

(21) Appl. No.: 11/069,274

(22) Filed: Mar. 1, 2005

(65) Prior Publication Data

US 2005/0193490 A1 Sep. 8, 2005

(30) Foreign Application Priority Data

Mar. 2, 2004 (CA) ..... 2459451

(51) Int. Cl.
*A47G 9/02* (2006.01)

(52) U.S. Cl. ..... 5/499; 5/500; 5/497

(58) Field of Classification Search ..... 5/497, 5/499, 500, 502
See application file for complete search history.

(56) References Cited

U.S. PATENT DOCUMENTS 4,672,702 A * 6/1987 Isham ..... 5/497
4,962,546 A * 10/1990 Vitale ..... 5/497
5,287,574 A * 2/1994 Kardell et al. ..... 5/499
5,325,555 A * 7/1994 Whitley ..... 5/500
5,765,241 A 6/1998 Macdonald
6,823,544 B1 * 11/2004 Treece ..... 5/497
2003/0056290 A1 3/2003 Macdonald

FOREIGN PATENT DOCUMENTS

DE 2521971 A1 11/1976
DE 4022332 A1 1/1992
EP 1 295 550 A1 3/2003
EP 1295550 A1 3/2003
EP 0 787 451 B2 6/2003

OTHER PUBLICATIONS

U.S. Appl. No. 08/276,963, filed Jul. 19, 1994, abandoned for failure to respond to an Office Action.
Copy of British search report issued in GB0504306.2

* cited by examiner

*Primary Examiner*—Michael Trettel
(74) *Attorney, Agent, or Firm*—Baker & Daniels LLP

(57) ABSTRACT

A mattress covering is described. The covering may be a sheet or a mattress pad. A mattress pad according to the present invention has: i) a central rectangular panel comprising a plurality of layers including an upper textile layer, a lower textile layer, and a batting layer quilted to at least one of the upper and lower textile layers. Side panels depend from the central panel, comprising a single layer of a textile fabric. End panels are defined by extensions of the central panel. The side panels are joined to the end panels by seams extending in a transverse direction in relation to the rectangular central panel.

5 Claims, 4 Drawing Sheets

TEXTILE CONSTRUCTION

The present invention relates to the field of bed linens. In particular, the present invention provides novel fitted mattress sheets and pads.

Mattress pads are coverings applied to mattresses generally either to provide additional cushioning, or to provide a waterproof surface. Mattress pads may simply sit on a mattress; they may be attached by straps at the corners of a mattress, or they may be fitted to a mattress. The most useful mattress pads are those fitted to a mattress, because they do not shift, or become loose or bunched up in use. It is especially important with children's mattress pads to ensure a good secure fit, so that a loose pad does not present a safety hazard.

Generally speaking, pads are made by providing a rectangular sheet of fabric having a width dimension about the same as a given mattress. A similarly dimensioned piece of batting is aligned on the fabric, and then a second piece of fabric, also of the same size, is aligned on the batting. This three-layer assembly is then machine quilted together, either one piece at a time in mattress size lengths, or in rolls of long lengths, to be cut for individual mattresses. A waterproof layer may be applied to the underside, or upper surface, if desired, by sewing side seams. Individual mattress sized pieces are then cut, and provided with side and end panels, corners are sewn joining the side and end panels, and elastic is applied to finish the exposed edges of the side and end panels. If desired, for a better fit, the side and end panels may be elasticized.

The product obtained using the manufacturing method outlined above is generally satisfactory, but is very labour intensive to make. Moreover, since the only thing keeping the pad on a mattress is the elastic, it must be quite robust, and therefore expensive.

The present invention provides a method of making fitted mattress pads, and mattress pads made by the method, that are an improvement in fit over known pads; but requiring less labour.

The present invention also provides fitted sheets. The fitted sheets of the present invention are characterized in that either the end, or the side, panels, thereof, are made from a knit fabric, and the remainder of the sheet is made from a woven fabric such as a flannel.

In a broad aspect, then, the present invention relates to a mattress pad having: i) a central rectangular panel comprising a plurality of layers including an upper textile layer, a lower textile layer, and a batting layer quilted to at least one of the upper and lower textile layers; ii) side panels depending from said central panel, comprising a single layer of a textile fabric; and iii) end panels defined by extensions of said central panel; said side panels being joined to said end panels by seams extending in a transverse direction in relation to said rectangular central panel.

ADDITIONAL STATEMENT OF INVENTION

In drawings that illustrate the present invention by way of example:

Figure 1:
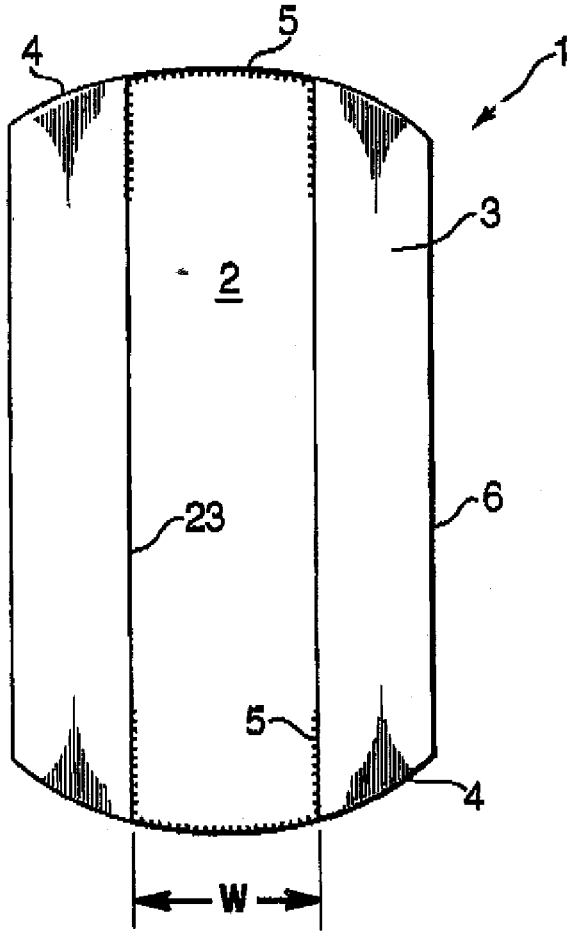
FIG. 1 is an underside view of a mattress pad made according to the present invention.

Referring to FIG. 1, the present invention provides a mattress pad 1 having a central portion that will be about the same width w as a selected mattress, and will have a length equal to the length of a selected mattress, plus about twice, or slightly more than twice the depth of such a mattress. Side panels 3 are at least about 1.2 times the depth to about twice of the selected mattress and extend from the central panels and are folded over the central portion. The top and bottom edges are then cut, on a slight curve, and a seam is sewn across each of the top and bottom edges. Elastic 5 may be sewn at each end of the construction, up one inner side edge of a side panel, across the end of the central panel, and down the inner side edge of the other side panel. The resultant pad is not provided with corners as provided in prior art pads, but rather the side panels 3 will extend down the side of a mattress, and under it slightly. The ends of the central panel 2 will cover the ends of the mattress, and the elastic in the ends, as well as the slight curvature in the ends, will serve to keep the ends of the mattress pad snug on a mattress.

The side panels 3 may be integral with the central panel 2, or they may be sewn thereto by seams extending down the side edges 6 of the central panel 2. If the side panels are made from a knit fabric with natural stretch capabilities, elastic 5 may be eliminated.

Figure 3:
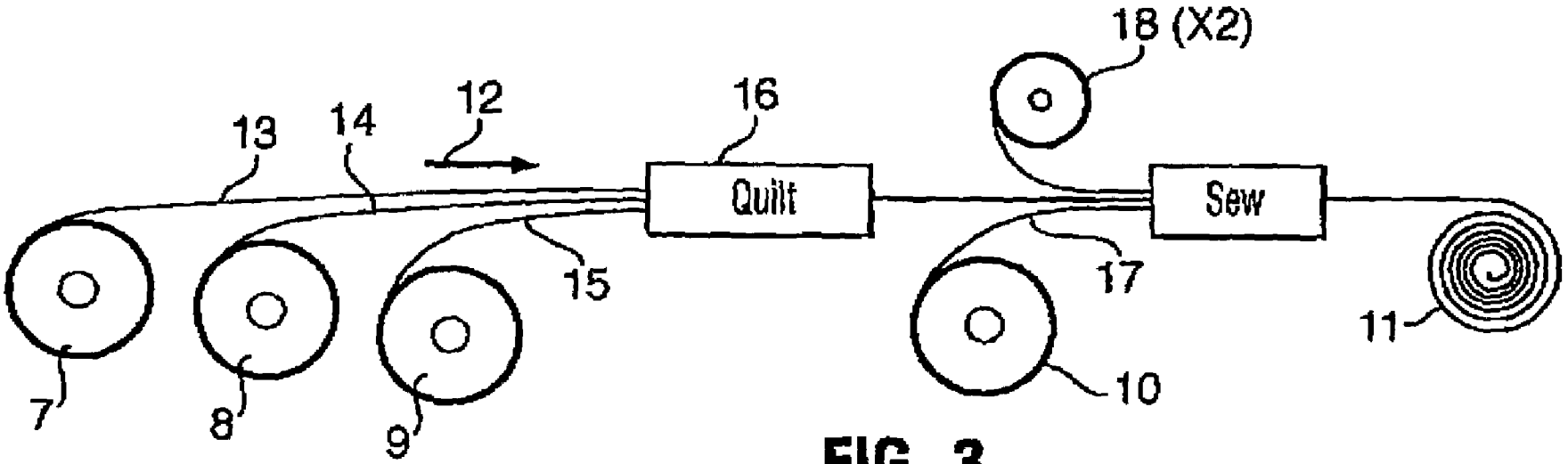
FIG. 3 is a schematic view of a portion of the manufacturing method of the present invention.
Figure 3A:
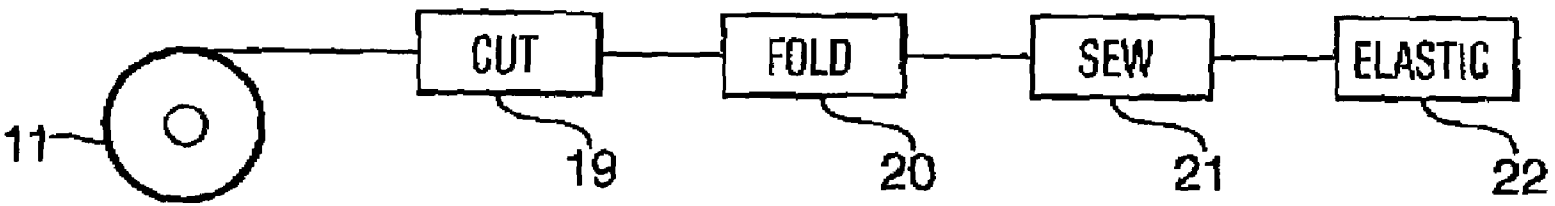
FIG. 3A is a schematic view of another portion of the manufacturing method of the present invention.

A preferred manufacturing method to make the mattress pads of the present invention is shown in FIGS. 3 and 3A. A first roll 7 of a textile material 13, that may be woven or knit, is unrolled in the direction noted by arrow 12. Slightly downstream, a batting 14, which may be cotton, polyester, or any other conventional material, is unwound from roll 8 also in direction 12, aligned with material 13. Another roll 9 of a textile 15, woven or knit, is unwound, also aligned with rolls 7 and 8, so that a three-layer sandwich of textile/batting/textile is created. The three-layer sandwich is then quilted at the quilting station 16, in a conventional manner, and continues to proceed in direction 12. A further layer, such as a waterproof layer 17, is aligned with the quilted construction downstream of quilting station, fed off a roll 10. The optional waterproof layer 17 is sewn, along the side edges thereof to the quilted construction, and then the four layer construction may be wound onto a roll 11.

At this point, it will be noted that either one of the two textile layers 13 or 15 may be wider than the other layers, in that it may include side panels 3 integral therewith. In such a case, there is no need to sew side panels to the textile construction. If, however, it is desired to have side panels 3 made from a different material, say a knit fabric when the central panel 2 is a woven material, or even if it is simply desired to have the side panels having a different visual appeal than the central panel the side panels may be sewn to the construction at the same time as the waterproof layer, using the same side seams. In that case, side panel material will be fed off two rolls of material 18 to meet the construction at about the same point as the waterproof material 17. Alternatively, the side panel material may be sewn to the central panel 2 by hand, in two pieces, during final assembly.

As shown in FIG. 3A, after the textile construction is wound onto roll 11, it is subsequently unwound when desired, and in four steps fabricated into fitted bed pads.

First, the construction is cut at station 19, into correct lengths, about the length of a selected mattress plus twice the depth (or slightly more). Then, the side panels are folded over, at station 20, and then an arcuate seam 4 is sewn across each end. As the seam 4 is sewn, the edge will also be cut by a blade in the sewing machine, in a conventional manner. It will be understood that for greater efficiency, if the side panels are folded over before the cutting process, the cutting and sewing may be done in a single step. Moreover, it will be understood that winding the construction onto a roll 11 is not necessary if the mill is equipped to cut, fold and sew the construction as it is fabricated.

After end seams 4 are sewn, elastic 5 may be applied to each end. As illustrated, elastic 5 may be applied along the inside edge 23 of side panel 3 near each end edge, across the end edge, and down the adjacent inside edge 2:3 of the opposite side panel.

Figure 2:
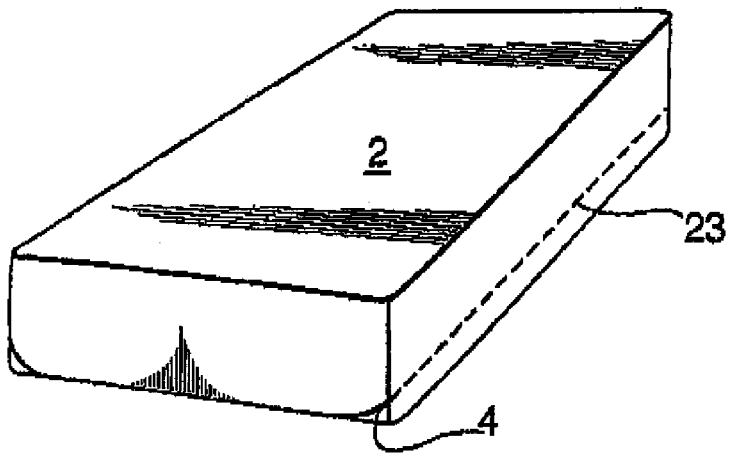
FIG. 2 is a perspective view of a mattress dressed with the mattress pad of FIG. 1.

The resultant bed pad should be turned inside-out to hide exposed seams, and will fit on a mattress as shown in FIG. 2, with the side panels under the mattress for the full length of the mattress. The side panels may be from about 1.2 to 2 times the depth of the mattress, for a proper fit. As shown in FIG. 2, the curvature of the end seams helps to ensure a fairly flat fit at each end of the mattress.

Figure 4:
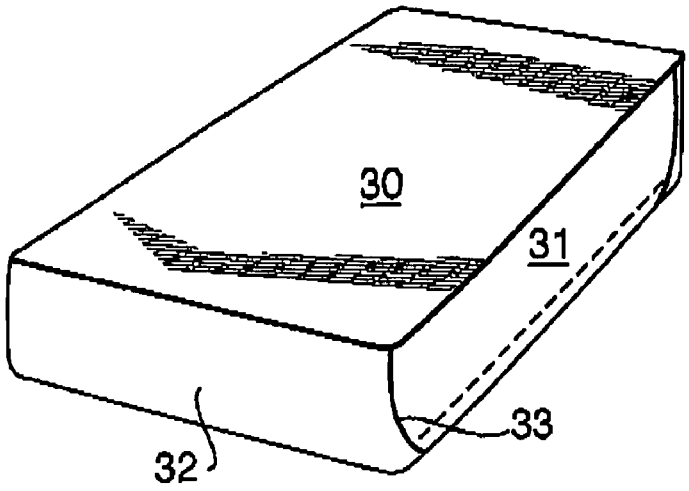
FIG. 4 is a perspective of a fitted bed sheet according to another embodiment of the present invention, fitted on a mattress.
Figure 5:
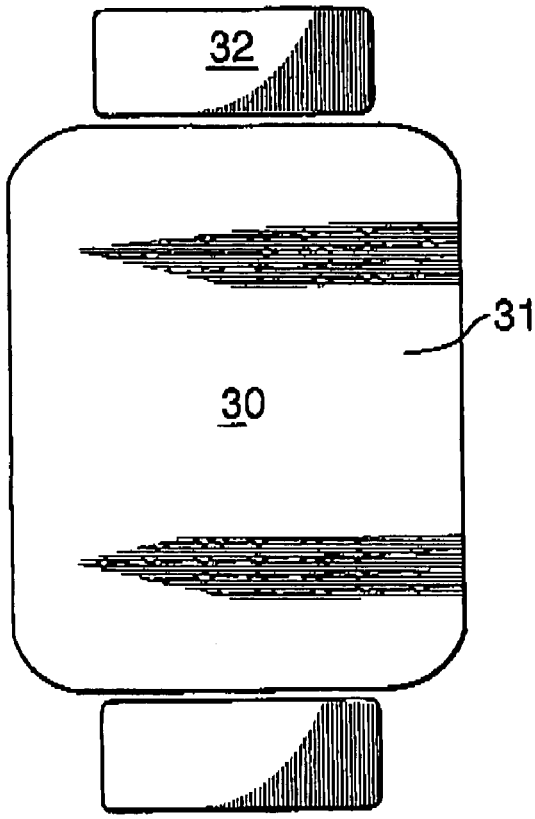
FIG. 5 is a pattern for the fitted sheet of FIG. 4.

Referring now to FIGS. 4 and 5, a further embodiment of the present invention is illustrated. In this embodiment, a central panel 30 has side panels 31 integral therewith, the central 30 and side 31 panels being made from a non-stretch fabric such as cotton flannelette. Any woven fabric may be used, though. Moreover, the integral central and side panels may be laminated with, or coated with, a waterproof layer, such as PVC.

End panels 32 of a stretch material such as a knit fabric are sewn to the ends of the central panel, and then corner seams 33 are sewn between the and panels 32 and the side panels 31. The elastic nature of the end panel results in a fitted sheet that fits snugly on a mattress. The end and side panels will, therefore, be of a width equal to or greater than (by a factor of up to about 0.1–0.5) the depth of a selected mattress.

Figure 6:
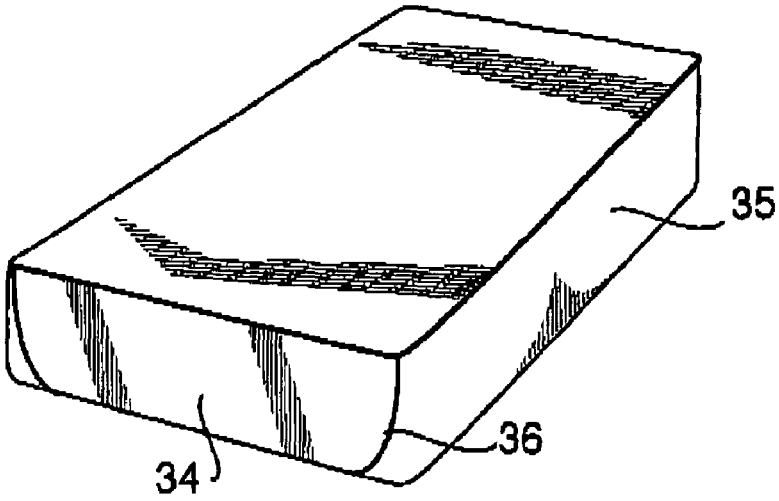
FIG. 6 is a perspective of a fitted bed sheet according to another embodiment of the present invention, fitted on a mattress.
Figure 7:
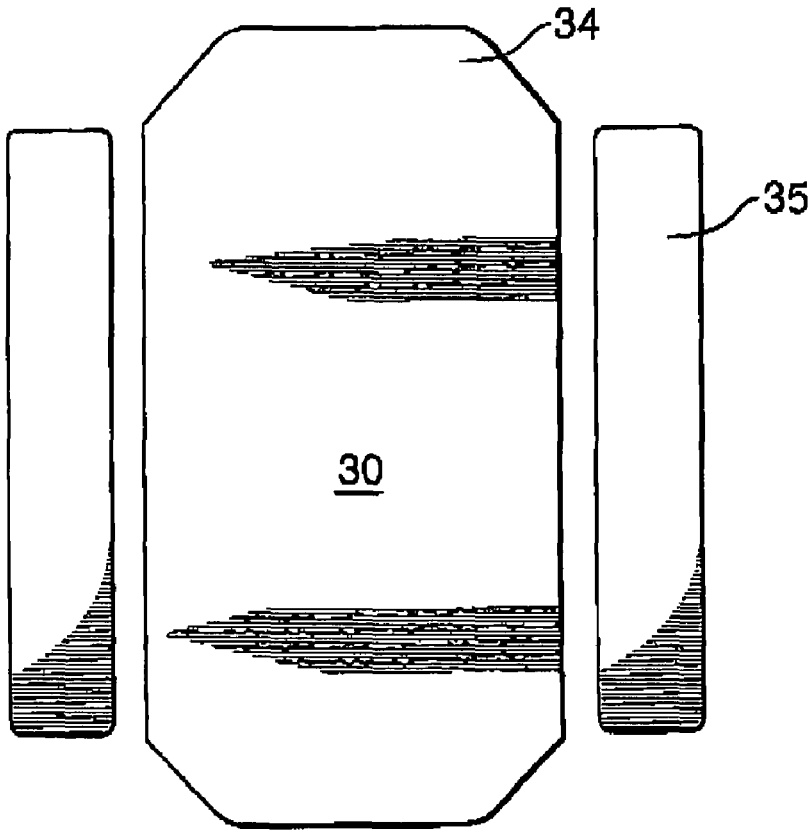
FIG. 7 is a pattern for the fitted sheet of FIG. 6.

It will also be appreciated that, as shown in FIGS. 6 and 7, the end panel 34 may be integral with the central panel 30, and therefore made from a woven non-stretch material. In such a case the side panels 35 are made from a stretch material, sewn along their length to the central panel, and joined in the corners to the end panels 34 by seams 36.

The embodiments of the invention in which an exclusive property or privilege is claimed as follows:

1. A mattress pad having:

i) a central rectangular panel comprising a plurality of layers including an upper textile layer, a lower textile layer, and a batting layer quilted to at least one of the upper and lower textile layers, said central panel having a length of about the length of a selected mattress plus twice the depth thereof, said central panel having a lengthwise direction;

ii) side panels depending from said central panel, comprising a single layer of a textile fabric, said side panels having a width 1.2 to 2 time the depth of said selected mattress; and iii) end panels having end panel ends defined by the ends of said central panel, said end panel ends being arcuate, said side panels being joined to said end panels by seams extending in a transverse direction in relation to the lengthwise direction of said rectangular central panel.

2. A fitted sheet as claimed in claim 1 wherein;

i) said central rectangular panel, with said end panels integral therewith, is made from a woven material; and ii) said side panels are sewn to the side edges of said central panel and end panels, and are made from a stretchable fabric.

3. A mattress pad as claimed in claim 1, further comprising elastic binding on the inside edge of the end portions of said side panels, and on the exposed portion of the ends of said central panel.

4. A mattress pad as claimed in claim 1, further including a waterproof layer.

5. A mattress pad as claimed in claim 4, wherein a selected one of said upper or lower textile layers includes said side panels integral therewith.

* * * * *